US005549838A

United States Patent [19]

Miyagawa et al.

[11] Patent Number: 5,549,838

[45] Date of Patent: Aug. 27, 1996

[54] HYDRAULIC WORKING OIL COMPOSITION FOR BUFFERS

[75] Inventors: Toru Miyagawa; Mitsuo Okada; Tomomasa Osumi, all of Yokohama, Japan

[73] Assignee: Nippon Oil Co., Ltd., Tokyo, Japan

[21] Appl. No.: 407,284

[22] Filed: Mar. 20, 1995

[30] Foreign Application Priority Data

Mar. 25, 1994 [JP] Japan ..... 6-077840

[51] Int. Cl.[6] ..... C09K 5/00

[52] U.S. Cl. ..... 252/75; 252/76; 252/78.3; 252/78.5

[58] Field of Search ..... 252/77, 78.5, 75, 252/76, 78.3

[56] References Cited

U.S. PATENT DOCUMENTS

| | | | |
|---|---|---|---|
| 3,090,758 | 5/1963 | Lonstrup et al. | 252/77 |
| 3,203,904 | 8/1965 | Brown | 252/77 |
| 3,280,029 | 10/1966 | Waldmann | 252/77 |
| 3,645,903 | 2/1972 | Stram et al. | 252/77 |
| 4,543,199 | 9/1985 | Kuntschik et al. | 252/77 |
| 4,548,726 | 10/1985 | Morris-Sherwood et al. | 252/77 |
| 4,795,583 | 1/1989 | Papy | 252/77 |
| 5,320,768 | 6/1994 | Gutierrez et al. | 252/77 |
| 5,382,374 | 1/1995 | Takemitsu et al. | 252/77 |

FOREIGN PATENT DOCUMENTS

| | | | |
|---|---|---|---|
| 0701280 | 1/1965 | Canada | 252/77 |

OTHER PUBLICATIONS

Abstract JP–05255683–, Naoto.

*Primary Examiner*—Margaret Medley
*Attorney, Agent, or Firm*—Bucknam and Archer

[57] ABSTRACT

A hydraulic working oil composition for buffers which comprises:

a lubricating oil as a base oil,

[I] at least one phosphorus-containing compound selected from the group consisting of a phosphoric acid having a specific structure and a phosphorous acid ester having a specific structure, and

[II] at least one nitrogen-containing compound selected from the group consisting of an alkyleneoxide adduct of an aliphatic monoamine having a specific structure, an aliphatic polyamine having a specific structure and a salt of the above aliphatic polyamine having a specific structure, and

[III] an aliphatic monoamine having a specific structure, the components [I] to [III] being essential components added to said base oil in a predetermined ratio; and a process for lubricating buffers with said hydraulic working oil composition.

19 Claims, No Drawings

HYDRAULIC WORKING OIL COMPOSITION FOR BUFFERS

BACKGROUND OF THE INVENTION

1. Field of the Invention

This invention relates to hydraulic working oil compositions for use in buffers and more particularly to such oil compositions suitable for use in car suspension devices such as shock absorbers, active suspensions, stay dampers and engine dampers.

2. Prior Art

As conventional hydraulic working oils which have hitherto been used in car buffer devices such as shock absorbers, active suspensions, stay dampers and engine dampers, there have been known those incorporated with a phosphoric acid ester and/or a phosphorus acid ester to provide the car buffer devices with friction-reducing properties and wear-preventing properties. In addition, there have also widely been used such hydraulic working oils in which are additionally used oily agents such as a fatty acid, aliphatic alcohol and fatty acid ester to further improve the working oils in friction-reducing properties.

Hydraulic working oils are those which are required to be capable of reducing friction at friction surfaces simultaneously with preventing wear of the friction surfaces. Recently, there have been increasingly used bush members impregnated with a Teflon resin in attempts to reduce friction at friction surfaces by having resort to such material or substance as above. Further, gas-sealed type and damping force-variable type buffers have particularly been increasingly used and, therefore, load applied to the friction surfaces of the buffers has been increased whereby conditions under which the buffers are used have come to be severe.

Consequently, Japanese Patent Application Laid-Open Gazette No. Hei 5-255683 (No. 255683/93) discloses, as a hydraulic working oil exhibiting excellent wear resistance and Friction characteristics even under severe conditions, a composition comprising a base oil which contains therein a phosphorus-containing compound such as a phosphoric acid ester or phosphorous acid ester and a nitrogen-containing compound comprising $C_{12}$-diethanolamine. The present inventors also found out that compositions comprising as essential components a phosphorus-containing compound such as a phosphoric acid ester or phosphorous acid ester, and a nitrogen-containing compound having a specific structure, in addition to a base lubricating oil, are particularly excellent in durability (little degradation with the time of use) of friction-reducing effect as a hydraulic working oil for a buffer, and previously filed a patent application based on this finding (Japanese Patent Application No. Hei 6-37528).

Although hydraulic working oil compositions for a buffer which have an excellent wear-preventing effect can be obtained by the combined use of the nitrogen-containing compound, which is described in the above two Japanese patent applications, and the phosphorus-containing compound; however, they have been found to raise problems because their storage stability is deteriorated so as to produce sludges when the content of the nitrogen-containing compound is increased, while their durability of friction-reducing effect is deteriorated when the content thereof is decreased to such an extent as not to worsen their storage stability.

SUMMARY OF THE INVENTION

A primary object of this invention is to provide hydraulic working oil compositions for a buffer which are excellent not only in durability (little degradation with the time of use) of friction-reducing and wear-preventing effects but also in storage stability. A further object of this invention is to provide hydraulic working oil compositions for a buffer which are excellent in adaptability to novel Teflon resin impregnated bush members.

The present inventors made intensive studies to achieve the above objects and, as the result of their studies, found that the above objects can be achieved by the combined use of [I] a phosphorus-containing compound having a specific structure, [II] a nitrogen-containing compound having a specific structure and [III] an aliphatic monoamine having a specific structure as essential components in a lubricating oil as a base oil, in respective specified amounts, thus completing this invention.

The present invention will now be described in more detail.

The primary object of this invention is achieved by providing a hydraulic working oil composition prepared by adding to a lubricating oil as a base oil the following ingredients as essential components [II] at least one kind of a phosphorus-containing compound selected from the group consisting of the following components (A) and (B):

(A) a phosphoric acid ester represented by the following general formula (1)

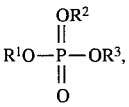

(1)

(B) a phosphorous acid ester represented by the following general formula (2)

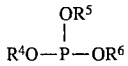

(2)

wherein $R^1$ and $R^4$ are each an alkyl or alkenyl group having 4–22 carbon atoms, an aryl, alkylaryl or arylalkyl group each having 6–22 carbon atoms; $R^2$ and $R^3$, and $R^5$ and $R^6$ may be identical with, or different from, each other, respectively, and these $R^2$, $R^3$, $R^5$ and $R^6$ are each hydrogen, an alkyl or alkenyl group having 1–22 carbon atoms, an aryl, alkylaryl or arylalkyl group having 6–22 carbon atoms, and [II] at least one kind of a nitrogen-containing compound selected from the group consisting of the following components (C) to (E):

(C) an alkyleneoxide adduct of an aliphatic monoamine represented by the following general formula (3)

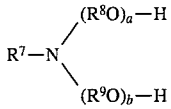

(3)

wherein $R^7$ is an alkyl or alkenyl group having 6–22 carbon atoms, $R^8$ and $R^9$ may be identical with, or different from, each other, and these $R^8$ and $R^9$ are each an alkylene group having 2–4 carbon atoms, a and b may be identical with, or different from, each other and are an integer of 0 to 10, and a+b=1 to 10, (D) an aliphatic polyamine represented by the following general formula (4)

$$R^{10}\text{-}(NH-R^{11})_c\text{-}NH_2 \quad (4)$$

wherein $R^{10}$ is an alkyl or alkenyl group having 6–22 carbon atoms, $R^{11}$ is an alkylene group having 2–4 carbon atoms, and c is an integer of 1 to 4, and (E) a salt of the above aliphatic polyamine (D) with an aliphatic acid having 6–22 carbon atoms, and

[III] (F) an aliphatic monoamine represented by the following general formula (5)

$$R^{12}—NH_2 \quad (5)$$

wherein $R^{12}$ is an alkyl or alkenyl group having 6–22 carbon atoms, the compounds [I] to [III] being each required to satisfy the following formulas (6) to (8):

$$W_I=0.1-5.0 \quad (6)$$

$$W_I/(W_{II}+W_{III})=1.5-20.0 \quad (7)$$

$$W_{II}/W_{III}=0.2-2.0 \quad (8)$$

Wherein $W_I$, $W_{II}$ and $W_{III}$ represent the contents of components [I], [II] and [III] in the hydraulic working oil composition, respectively, and the contents being each expressed in % by weight based on the total weight of the composition.

The lubricating oils used as a base oil in this invention are not particularly limited, and both mineral oils and synthetic oils which are usually used as a base oil for lubricating oils may be used in this invention.

The mineral oil-type lubricating oils which may be used as a base oil, include paraffinic and naphthenic oils obtained by refining, for example, lubricating oil fractions obtained by the atmospheric and reduced-pressure distillation of a crude oil, by means of a suitable combination of solvent deasphalting, solvent extraction, hydrocracking, solvent dewaxing, catalytic dewaxing, hydrorefining, sulfuric acid washing, clay treatment, and the like. The synthetic oil-type lubricating oils which may be used as a base oil, include poly α-olefins (polybutene, 1-octene oligomers, 1-decene oligomers, etc.), alkylbenzenes, alkylnaphthalenes, diesters (ditridecyl glutarate, di-2-ethylhexyl adipate, diisodecyl adipate, ditridecyl adipate, di-2-ethylhexyl sebacate, etc.), polyol esters (trimethylolpropane caprylate, trimethylolpropane peralgonate, pentaerithritol 2-ethyl hexanoate, pentaerithritol peralgonate, etc.), polyoxyalkylene glycol, polyphenyl ethers, silicone oil and perfluoroalkyl ethers. The lubricating oils used as a base oil are hereinafter sometimes referred to as "base lubricating oils" for simplicity. The base lubricating oils may be used singly of jointly, but the mineral oil-type base lubricating oils are preferably used from the standpoint of their adaptability to, or compatibility with, gum sealants in this invention.

The base lubricating oils used in this invention are optional in viscosity, but those having a viscosity of 8–60 cSt, preferably 10–40 cSt, at 40° C. are usually used from necessity for their applicability to damping force required in general buffers.

The component [I] which is an essential additive to be added to a base lubricating oil according to this invention is at least one phosphorus-containing compound selected from the group consisting of (A) a phosphoric acid ester represented by the following general formula (1), (B) a phosphorous acid ester represented by the following general formula (2):

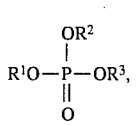

$$R^1O—P(=O)(OR^2)—OR^3, \quad (1)$$

-continued

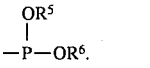

$$R^4O—P(OR^5)—OR^6. \quad (2)$$

In these formulae (1) and (2), $R^1$ and $R^4$ are each a straight-chain or branched-chain alkyl or alkenyl group having 4–22 carbon atoms, an aryl, alkylaryl or arylalkyl group having a straight-chain or branched-chain alkyl group, the aryl, alkylaryl and arylalkyl groups each having 6–22 carbon atoms; $R^2$ and $R^3$, and $R^5$ and $R^6$, may be identical with, or different from, each other, respectively, and these $R^2$, $R^3$, $R^5$ and $R^6$ are each a straight-chain or branched-chain alkyl or alkenyl group having 1–22 carbon atoms, an aryl, alkylaryl or arylalkyl group each having 6–22 carbon atoms, the alkyl group in these alkylaryl and arylalkyl groups being a straight-chain or branched-chain alkyl group.

The $R^1$ and $R^4$ each include an alkyl group such as butyl groups (including all isomeric groups), pentyl groups (including all isomeric groups), hexyl groups (including all isomeric groups), heptyl groups (including all isomeric groups), octyl groups (including all isomeric groups), nonyl groups (including all isomeric groups), decyl groups (including all isomeric groups), undecyl groups (including all isomeric groups), dodecyl groups (including all isomeric groups), tridecyl groups (including all isomeric groups), tetradecyl groups (including all isomeric groups), pentadecyl groups (including all isomeric groups), hexadecyl groups (including all isomeric groups), heptadecyl groups (including all isomeric groups), octadecyl groups (including all isomeric groups), nonadecyl groups (including all isomeric groups), eicosyl groups (including all isomeric groups), heneicosyl groups (including all isomeric groups) and docosyl groups (including all isomeric groups); an alkenyl group such as butenyl groups (including all isomeric groups), pantenyl groups (including all isomeric groups), hexenyl groups (including all isomeric groups), heptenyl groups (including all isomeric groups), octenyl groups (including all isomeric groups), nonenyl groups (including all isomeric groups), decenyl groups (including all isomeric groups), undecenyl groups (including all isomeric groups), dodecenyl groups (including all isomeric groups), tridecenyl groups (including all isomeric groups), tetradecenyl groups (including all isomeric groups), pentadecenyl groups (including all isomeric groups), hexadecenyl groups (including all isomeric groups), heptadecenyl groups (including all isomeric groups), octadecenyl groups (including all isomeric groups), nonadecenyl groups (including all isomeric groups), eicosenyl groups (including all isomeric groups), heneicosenyl groups (including all isomeric groups) and docosenyl groups (including all isomeric groups); an aryl group such as a phenyl group and naphtyl groups (including all isomeric groups); an alkylaryl group such as tolyl groups (including all isomeric groups), ethylphenyl groups (including all isomeric groups), propylphenyl groups (including all isomeric groups), butylphenyl groups (including all isomeric groups), pentylphenyl groups (including all isomeric groups), hexylphenyl groups (including all isomeric groups), heptylphenyl groups (including all isomeric groups), octylphenyl groups (including all isomeric groups), nonylphenyl groups (including all isomeric groups), decylphenyl groups (including all isomeric groups), undecylphenyl groups (including all isomeric groups), dodecylphenyl groups (including all isomeric groups), tridecylphenyl groups (including all isomeric groups), tetradecylphenyl groups (including all isomeric groups), pentadecylphenyl groups (including all isomeric groups), hexadecylphenyl groups (including all isomeric groups), xylyl groups (including all isomeric groups), ethylmethylphenyl groups (including all isomeric groups), diethylphenyl groups (including all isomeric groups), dipropylphenyl groups (including all isomeric groups), dibutylphenyl groups (including all isomeric groups), methylnaphtyl groups (including all isomeric groups), ethylnaphtyl groups (including all isomeric groups), propylnaphtyl groups (including all isomeric groups), butylnaphtyl groups (including all isomeric groups), dimethylnaphtyl groups (including all isomeric groups), ethylmethylnaphtyl groups (including all isomeric groups), diethylnaphtyl groups (including all isomeric groups), dipropylnaphtyl groups (including all isomeric groups) and dibutylnaphtyl groups (including all isomeric groups); an arylalkyl group such as a benzyl group, phenylethyl groups (including all isomeric groups) and phenylpropyl groups (including all isometric groups).

On the other hand, the $R^2$ and $R^3$, and the $R^5$ and $R^6$, each include hydrogen, an alkyl group such as methyl group, ethyl group, propyl groups (including all isomeric groups), butyl groups (including all isomeric groups), pentyl groups (including all isomeric groups), hexyl groups (including all isomeric groups), heptyl groups (including all isomeric groups), octyl groups (including all isomeric groups), nonyl groups (including all isomeric groups), decyl groups (including all isomeric groups), undecyl groups (including all isomeric groups), dodecyl groups (including all isomeric groups), tridecyl groups (including all isomeric groups), tetradecyl groups (including all isomeric groups), pentadecyl groups (including all isomeric groups), hexadecyl groups (including all isomeric groups), heptadecyl groups (including all isomeric groups), octadecyl groups (including all isomeric groups), nonadecyl groups (including all isomeric groups), eicosyl groups (including all isomeric groups), heneicosyl groups (including all isomeric groups) and docosyl groups (including all isomeric groups); an alkenyl group such as butenyl groups (including all isomeric groups), pentenyl groups (including all isomeric groups), hexenyl groups (including all isomeric groups), heptenyl groups (including all isomeric groups), octenyl groups (including all isomeric groups), nonenyl groups (including all isomeric groups), decenyl groups (including all isomeric groups), undecenyl groups (including all isomeric groups), dodecenyl groups (including all isomeric groups), tridecenyl groups (including all isomeric groups), tetradecenyl groups (including all isomeric groups), pentadecenyl groups (including all isomeric groups), hexadecenyl groups (including all isomeric groups), heptadecenyl groups (including all isomeric groups), octadecenyl groups (including all isomeric groups), nonadecenyl groups (including all isomeric groups), eicosenyl groups (including all isomeric groups), heneicosenyl groups (including all isomeric groups) and docosenyl groups (including all isomeric groups); an aryl group such as a phenyl group and naphtyl groups (including all isomeric groups); an alkylaryl group such as tolyl groups (including all isomeric groups), ethylphenyl groups (including all isomeric groups), propylphenyl groups (including all isomeric groups), butylphenyl groups (including all isomeric groups), pentylphenyl groups (including all isomeric groups), hexylphenyl groups (including all isomeric groups), heptylphenyl groups (including all isomeric groups), octylphenyl groups (including all isomeric groups), nonylphenyl groups (including all isomeric groups), decylphenyl groups (including all isomeric groups), undecylphenyl groups (including all isomeric groups), dodecylphenyl groups (including all isomeric groups), tridecylphenyl groups (including all isomeric groups), tetradecylphenyl groups (including all isomeric groups), pentadecylphenyl groups (including all isomeric groups), hexadecylphenyl groups (including all isomeric groups), xylyl groups (including all isomeric groups), ethylmethylphenyl groups (including all isomeric groups), diethylphenyl groups (including all isomeric groups), dipropylphenyl groups (including all isomeric groups), dibutylphenyl groups (including all isomeric groups), methylnaphtyl groups (including all isomeric groups), ethylnaphtyl groups (including all isomeric groups), propylnaphtyl groups (including all isomeric groups), butylnaphtyl groups (including all isomeric groups), dimethylnaphtyl groups (including all isomeric groups), ethylmethylnaphtyl groups (including all isomeric groups), diethylnaphtyl groups (including all isomeric groups), dipropylnaphtyl groups (including all isomeric groups) and dibutylnaphtyl groups (including all isomeric groups); an arylalkyl group such as benzyl groups phenylethyl groups (including all isomeric groups) and phenylpropyl groups (including all isomeric groups).

From the standpoint of its excellency particularly in wear-preventing and friction-reducing effects, the preferable phosphoric acid ester of the component (a) used in this invention is a diester compound of the formula (1) wherein $R^1$ and $R^2$ are each a member selected from a straight-chain or branched-chain alkyl or alkenyl group having 6 to 20 carbon atoms and a monoalkylphenyl group having 14–20 carbon atoms in which the alkyl is a straight-chain or branched-chain one, and $R^3$ is hydrogen. The more preferable phosphoric acid ester is a diester compound of the formula (1) wherein $R^1$ and $R^2$ are each a member selected from a straight-chain or branched-chain alkyl or alkenyl group having 8 to 18 carbon atoms, and $R^3$ is hydrogen.

The preferable phosphoric acid diesters (a) include dioctyl acid phosphates (including all isomers), didecyl acid phosphates (including all isomers), didodecyl acid phosphates (including all isomers), ditetradecyl acid phosphates (including all isomers), dihexadecyl acid phosphate (including all isomers), dioctadecyl acid phosphates (including all isomers), dioctadecenyl acid phosphates (including all isomers) and mixtures thereof.

In the same manner as in the phosphoric acid ester of the formula (1), from the standpoint of its excellency particularly in wear-preventing and friction-reducing effects the preferable phosphorous acid ester of the component (b) used in this invention is a diester compound of the formula (2) wherein $R^4$ and $R^5$ are each a member selected from a straight-chain or branched-chain alkyl or alkenyl group having 6 to 20 carbon atoms and a monoalkylphenyl group having 14–20 carbon atoms in which the alkyl is a straight-chain or branched-chain one, and $R^6$ is hydrogen. The more preferable phosphorous acid ester is a diester compound of the formula (2) wherein $R^4$ and $R^5$ are each a straight-chain alkyl or alkenyl group having 8 to 18 carbon atoms, and $R^6$ is hydrogen.

The more preferable phosphorous acid diesters (b) include dioctyl hydrogen phosphites (including all isomers), didecyl hydrogen phosphites (including all isomers), didodecyl hydrogen phosphites (including all isomers), ditetradecyl hydrogen phosphites (including all isomers), dihexadecyl hydrogen phosphites (including all isomers), dioctadecyl hydrogen phosphites (including all isomers), dioctadecenyl hydrogen phosphites (including all isomers) and mixtures thereof.

The component [II] which is an essential additive to be added to a base lubricating oil according to this invention is at least one kind of a nitrogen-containing compound selected from the group consisting of (C) an alkyleneoxide adduct of an aliphatic monoamine, (D) an aliphatic polyamine and (E) an aliphatic acid salt of an aliphatic polyamine.

The alkyleneoxide adduct of an aliphatic monoamine (C) of the component [II] defined herein means a compound represented by the Following general formula (3)

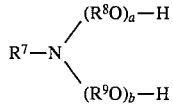

(3)

wherein $R^7$ is a straight-chain or branched-chain alkyl or alkenyl group having 6–22, preferably 8–18, carbon atoms, $R^8$ and $R^9$ may be identical with, or different from, each other, and these $R^8$ and $R^9$ are each a straight-chain or branched-chain alkylene group having 2–4 carbon atoms, a and b may be identical with, or different from, each other, and are each an integer of 0 to 10 and a+b=1 to 10, preferably 1 to 5.

The $R^7$ is exemplified by an alkyl group such as hexyl groups (including all isomeric group), heptyl groups (including all isomeric group), octyl groups (including all isomeric group), nonyl groups (including all isomeric group), decyl groups (including all isomeric group), undecyl groups (including all isomeric group), dodecyl groups (including all isomeric group), tridecyl groups (including all isomeric group), tetradecyl groups (including all isomeric group), pentadecyl groups (including all isomeric group), hexadecyl groups (including all isomeric group), heptadecyl groups (including all isomeric group), octadecyl groups (including all isomeric group), nonadecyl groups (including all isomeric group), eicosyl groups (including all isomeric group), heneicosyl groups (including all isomeric group) and docosyl groups (including all isomeric group); and an alkenyl group such as octenyl groups (including all isomeric group), nonenyl groups (including all isomeric group), decenyl groups (including all isomeric group), undecenyl groups (including all isomeric group), docenyl groups (including all isomeric group), tridecenyl groups (including all isomeric group), tetradecenyl groups (including all isomeric group), pentadecenyl groups (including all isomeric group), hexadecenyl groups (including all isomeric group), peptadecenyl groups (including all isomeric group), octadecenyl groups (including all isomeric group), nonadecenyl groups (including all isomeric group), eicosenyl groups (including all isomeric group), heneicosenyl groups (including all isomeric group) and docosenyl groups (including all isomeric group); and an aliphatic group derived from fats and oils such as tallow, hardened tallow, coconut oil and soybean oil. The $R^8$ includes an ethylene group, trimethylene group, 1-methylethylene group, 2-methylethylene group, tetramethylene group, 1-methyltrimethylene group, 2-methyltrimethylene group, 3-methyltrimethylene group, 1-ethylethylene group, 2-ethylethylene group, 1,1-dimethylethylene group, 1,2-dimethylethylene group and 2,2-dimethylethylene group.

From the standpoint of its excellency particularly in friction-reducing effect, the alkyleneoxide adduct of an aliphatic monoamine (C) of the component [II] used in this invention is preferably a compound of the formula (3) wherein $R^7$ is a member selected from a straight-chain alkyl or straight-chain alkenyl group having 8 to 18 carbon atoms and $R^8$ and $R^9$ are each ethylene group or propylene group.

Particularly preferable compounds as the alkyleneoxide adduct of an aliphatic monoamine (C) of the component [II] used in this invention include octyl amine (capryl amine), decyl amine, dodecyl amine (lauryl amine), tetradecyl amine (myristyl amine), hexadecyl amine (palmityl amine), octadecyl amine (stearyl amine), 9-octadecenyl amine (oleyl amine), or an ethyleneoxide adduct or propyleneoxide adduct of an aliphatic monoamine derived from fats and oils such as tallow, hardened tallow, coconut oil or soybean oil, and a mixture thereof.

The aliphatic polyamine (D) of the component [II] defined herein means compounds represented by the following general formula (4)

$$R^{10}\text{-}(NH-R^{11})_c\text{-}NH_2 \quad (4)$$

wherein $R^{10}$ is a straight-chain or branched-chain alkyl or alkenyl group having 6–22 carbon atoms, $R^{11}$ is a straight-chain or branched-chain alkylene group having 2–4 carbon atoms, and c is an integer of 1 to 4.

The $R^{10}$ is exemplified by an alkyl group such as hexyl groups (including all isomeric group), heptyl groups (including all isomeric group), octyl groups (including all isomeric group), nonyl groups (including all isomeric group), decyl groups (including all isomeric group), undecyl groups (including all isomeric group), dodecyl groups (including all isomeric group), tridecyl groups (including all isomeric group), tetradecyl groups (including all isomeric group), pentadecyl groups (including all isomeric group), hexadecyl groups (including all isomeric group), heptadecyl groups (including all isomeric group), octadecyl groups (including all isomeric group), nonadecyl groups (including all isomeric group), eicosyl groups (including all isomeric group), heneicosyl groups (including all isomeric group) and docosyl groups (including all isomeric group); and an alkenyl group such as octenyl groups (including all isomeric group), nonenyl groups (including all isomeric group), decenyl groups (including all isomeric group), undecenyl groups (including all isomeric group), docenyl groups (including all isomeric group), tridecenyl groups (including all isomeric group), tetradecenyl groups (including all isomeric group), pentadecenyl groups (including all isomeric group), hexadecenyl groups (including all isomeric group), peptadecenyl groups (including all isomeric group), octadecenyl groups (including all isomeric group), nonadecenyl groups (including all isomeric group), eicosenyl groups (including all isomeric group), heneicosenyl groups (including all isomeric group) and docosenyl groups (including all isomeric group); and an aliphatic group derived from fats and oils such as tallow, hardened tallow, coconut oil and soybean oil. The $R^{11}$ includes an ethylene group, trimethylene group, 1-methylethylene group, 2-methylethylene group, tetramethylene group, 1-methyltrimethylene group, 2-methyltrimethylene group, 3-methyltrimethylene group, 1-ethylethylene group, 2-ethylethylene group, 1,1-dimethylethylene group, 1,2-dimethylethylene group and 2,2-dimethylethylene group.

The aliphatic polyamine (D), which is represented by formula (4) and is among the components [II] used in this invention is preferably a specified compound of the formula (4) in which $R^{10}$ is a straight-chain alkyl or alkenyl group having 8–18 carbon atoms, and $R^{11}$ is an ethylene group or propylene group and a is an integer of 1, in view of the excellent wear-reducing performance of said specified compound.

In the component [II] used in the present invention, particularly preferable compounds as the above aliphatic polyamine (D) represented by the formula (4) include an aliphatic polyamine such as octyl ethylenediamine, octyl propylenediamine, decyl ethylenediamine, decyl propylenediamine, dodecyl ethylenediamine (lauryl ethylenediamine), dodecyl propylenediamine (lauryl propylenediamine), tetradecyl ethylenediamine (myristyl ethylenediamine), tetradecyl propylenediamine (myristyl propylenediamine), hexadecyl ethylenediamine (cetyl ethylenediamine), hexadecyl propylenediamine (cetyl propylenediamine), octadecyl ethylenediamine (stearyl ethylenediamine), octadecyl propylenediamine (stearyl propylenediamine), octadecenyl ethylenediamine (oleyl ethylenediamine), octadecenyl propylenediamine (oleyl propylenediamine), tallow ethylenediamine, tallow propylenediamine, hardened tallow ethylenediamine, hardened tallow propylenediamine, coconut ethylenediamine, coconut propylenediamine, soybean ethylenediamine, soybean propylenediamine and a mixture thereof.

The component (E), which is among the components [II] used in the present invention, is a salt of the aliphatic polyamine (D) with an aliphatic acid having 6–22 carbon atoms.

The aliphatic acid having 6–22 carbon atoms to be used in forming the salt may be a straight-chain or branched-chain one, and may be a saturated or unsaturated one. Among them, the straight-chain aliphatic acid having 8–18 carbon atoms is preferably used.

The preferable aliphatic acids include octanoic acid (caprylic acid), decanoic acid (capric acid), dodecanoic acid (lauric acid), tetradecanoic acid (myristic acid), hexadecanoic acid (palmitic acid), octadecanoic acid (stearic acid), octadecenoic acid (oleic acid), and tallow aliphatic acid, hardened tallow aliphatic acid, coconut oil aliphatic acid, soybean oil aliphatic acid and a mixture thereof.

The particularly preferable component (E) which is among the components [II] according to the present invention, includes a salt of at least one kind of an aliphatic polyamine with at least one kind of an aliphatic acid. The aliphatic polyamine is a member selected from the group consisting of octyl ethylenediamine, octyl propylenediamine, decyl ethylenediamine, decyl propylenediamine, dodecyl ethylenediamine (lauryl ethylenediamine), dodecyl propylenediamine (lauryl propylenediamine), tetradecyl ethylenediamine (myristyl ethylenediamine), tetradecyl propylenediamine (myristyl propylenediamine), hexadecyl ethylenediamine (cetyl ethylenediamine), hexadecyl propylenediamine (cetyl propylenediamine), octadecyl ethylenediamine (stearyl ethylenediamine), octadecyl propylenediamine (stearyl propylenediamine), octadecenyl ethylenediamine (oleyl ethylenediamine), octadecenyl propylenediamine (oleyl propylenediamine), tallow ethylenediamine, tallow propylenediamine, hardened tallow ethylenediamine, hardened tallow propylenediamine, coconut ethylenediamine, coconut propylenediamine, soybean ethylenediamine, soybean propylenediamine and the like. The aliphatic acid is a member selected from the group consisting of octanoic acid (caprylic acid), decanoic acid (captic acid), dodecanoic acid (lauric acid), tetradecanoic acid (myristic acid), hexadecanoic acid (palmitic acid), octadecanoic acid (stearic acid), 9-octadecenic acid (oleic acid), tallow aliphatic acid, hardened tallow aliphatic acid, coconut oil aliphatic acid, soybean oil aliphatic acid and the like.

Furthermore, there is preferably used a salt in which one aliphatic acid per nitrogen atom in the aliphatic polyamine has been reacted with the aliphatic polyamine the salt being obtainable by reacting said acid with polyamine in equivalent amounts. This salt includes octyl ethylenediamine-dilaurate, octyl ethylenediamine-dimyristate, octyl ethylenediamine-dipalmitate, octyl ethylenediamine-distearate, octyl ethylenediamine-dioleate, octyl ethylenediamine-ditallow aliphatic acid salt, octyl ethylenediamine-dihardened tallow aliphatic acid salt, octyl ethylenediamine-dicoconut aliphatic acid salt, octyl ethylenediamine-disoybean aliphatic acid salt; octyl propylenediamine-dilaurate, octyl propylenediamine-dimyristate, octyl propylenediamine-dipalmitate, octyl propylenediamine-distearate, octyl propylenediamine-dioleate, octyl propylenediamine-ditallow aliphatic acid salt, octyl propylenediamine-dihardened tallow aliphatic acid salt, octyl propylenediamine-dicoconut aliphatic acid salt, octyl propylenediamine-disoybean aliphatic acid salt; decyl ethylenediamine-dilaurate, decyl ethylenediamine-dimyristate, decyl ethylenediamine-dipalmitate, decyl ethylenediamine-distearate, decyl ethylenediamine-dioleate, decyl ethylenediamine-ditallow aliphatic acid salt, decyl ethylenediamine-dihardened tallow aliphatic acid salt, decyl ethylenediamine-dicoconut aliphatic acid salt, decyl ethylenediamine-disoybean aliphatic acid salt; decyl propylenediamine-dilaurate, decyl propylenediamine-dimyristate, decyl propylenediamine-dipalmitate, decyl propylenediamine-distearate, decyl propylenediamine-dioleate, decyl propylenediamine-ditallow aliphatic acid salt, decyl propylene diamine-dihardened tallow aliphatic acid salt, decyl propylene diamine-dicoconut aliphatic acid salt, decyl propylene diamine-disoybean aliphatic acid salt; lauryl ethylenediamine-dilaurate, lauryl ethylenediamine-dimyristate, lauryl ethylenediamine-dipalmitate, lauryl ethylenediamine-distearate, lauryl ethylenediamine-dioleate, lauryl ethylenediamine-ditallow aliphatic acid salt, lauryl ethylenediamine-dihardened tallow aliphatic acid salt, lauryl ethylenediamine-dicoconut aliphatic acid salt, lauryl ethylenediamine-disoybean aliphatic acid salt; lauryl propylenediamine-dilaurate, lauryl propylene diamine-dimyristate, lauryl propylenediamine-dipalmitate, lauryl propylenediamine-distearate, lauryl propylenediamine-dioleate, lauryl propylenediamine-ditallow aliphatic acid salt, lauryl propylenediamine-dihardened tallow aliphatic acid salt, lauryl propylenediamine-dicoconut aliphatic acid salt, lauryl propylenediamine-disoybean aliphatic acid salt; myristyl ethylenediamine-dilaurate, myristyl ethylenediamine-dimyristate, myristyl ethylenediamine-dipalmitate, myristyl ethylenediamine-distearate, myristyl ethylenediamine-dioleate, myristyl ethylenediamine-ditallow aliphatic acid salt, myristyl ethylenediamine-dihardened tallow aliphatic acid salt, myristyl ethylenediamine-dicoconut aliphatic acid salt, myristyl ethylenediamine-disoybean aliphatic acid salt; myristyl propylenediamine-dilaurate, myristyl propylenediamine-dimyristate, myristyl propylenediamine-dipalmitate, myristyl propylenediamine-distearate, myristyl propylenediamine-dioleate, myristyl propylenediamine-ditallow aliphatic acid salt, myristyl propylenediamine-dihardened tallow aliphatic acid salt, myristyl propylenediamine-dicoconut aliphatic acid salt, myristyl propylenediamine-disoybean aliphatic acid salt; cetyl ethylenediamine-dilaurate, cetyl ethylenediamine-dimyristate, cetyl ethylenediamine-dipalmitate, cetyl ethylenediamine-distearate, cetyl ethylenediamine-dioleate, cetyl ethylenediamine-ditallow aliphatic acid salt, cetyl ethylenediamine-dihardened tallow aliphatic acid salt, cetyl ethylenediamine-dicoconut aliphatic acid salt, cetyl ethylenediamine-disoybean aliphatic acid salt; cetyl propylene diamine-dilaurate, cetyl propylenediamine-dimyristate, cetyl propylenediamine-dipalmitate, cetyl propylenediamine-distearate, cetyl propylenediamine-dioleate, cetyl propylenediamine-ditallow aliphatic acid salt, cetyl propylenediamine-dihardened tallow aliphatic acid salt, cetyl propylenediamine-dicoconut aliphatic acid salt, cetyl propylenediamine-disoybean aliphatic acid salt; stearyl ethylenediamine-dilaurate, stearyl ethylenediamine-dimyristate, stearyl ethylenediamine-dipalmitate, stearyl ethylenediamine-distearate, stearyl ethylenediamine-dioleate, stearyl ethylenediamine-ditallow aliphatic acid salt, stearyl ethylenediamine-dihardened tallow aliphatic acid salt, stearyl ethylenediamine-dicoconut aliphatic acid salt, stearyl ethylenediamine-disoybean aliphatic acid salt; stearyl propylene diamine-dilaurate, stearyl propylenediamine-dimyristate, stearyl propylenediamine-dipalmitate, stearyl propylenediamine-distearate, stearyl propylenediamine-dioleate, stearyl propylenediamine-ditallow aliphatic acid salt, stearyl propylenediamine-dihardened tallow aliphatic acid salt, stearyl propylenediamine-dicoconut aliphatic acid salt, stearyl propylenediamine-disoybean aliphatic acid salt; oleyl ethylenediamine-dilaurate, oleyl ethylenediamine-dimyristate, oleyl ethylenediamine-dipalmitate, oleyl ethylenediamine-distearate, oleyl ethylenediamine-dioleate, oleyl ethylenediamine-ditallow aliphatic acid salt, oleyl ethylenediamine-dihardened tallow aliphatic acid salt, oleyl ethylenediamine-dicoconut aliphatic acid salt, oleyl ethylenediamine-disoybean aliphatic acid salt; oleyl propylene diamine-dilaurate, oleyl propylenediamine-dimyristate, oleyl propylenediamine-dipalmitate, oleyl propylenediamine-distearate, oleyl propylenediamine-dioleate, oleyl propylenediamine-ditallow aliphatic acid salt, oleyl propylenediamine-dihardened tallow aliphatic acid salt, oleyl propylenediamine-dicoconut aliphatic acid salt, oleyl propylenediamine-disoybean aliphatic acid salt; tallow ethylenediamine-dilaurate, tallow ethylenediamine-dimyristate, tallow ethylenediamine-dipalmitate, tallow ethylenediamine-distearate, tallow ethylenediamine-dioleate, tallow ethylenediamine-ditallow aliphatic acid salt, tallow ethylenediamine-dihardened tallow aliphatic acid salt, tallow ethylenediamine-dicoconut aliphatic acid salt, tallow ethylenediamine-disoybean aliphatic acid salt; tallow propylene diamine-dilaurate, tallow propylenediamine-dimyristate, tallow propylenediamine-dipalmitate, tallow propylenediamine-distearate, tallow propylenediamine-dioleate, tallow propylenediamine-ditallow aliphatic acid salt, tallow propylenediamine-dihardened tallow aliphatic acid salt, tallow propylenediamine-dicoconut aliphatic acid salt, tallow propylenediamine-disoybean aliphatic acid salt; hardened tallow ethylenediamine-dilaurate, hardened tallow ethylenediamine-dimyristate, hardened tallow ethylenediamine-dipalmitate, hardened tallow ethylenediamine-distearate, hardened tallow ethylenediamine-dioleate, hardened tallow ethylenediamine-ditallow aliphatic acid salt, hardened tallow ethylenediamine-dihardened tallow aliphatic acid salt, hardened tallow ethylenediamine-dicoconut aliphatic acid salt, hardened tallow ethylenediamine-disoybean aliphatic acid salt; hardened tallow propylenediamine-dilaurate, hardened tallow propylenediamine-dimyristate, hardened tallow propyrenediamine-dipalmitate, hardened tallow propylenediamine-distearate, hardened tallow propylenediamine-dioleate, hardened tallow propylenediamine-ditallow aliphatic acid salt, hardened tallow propylenediamine-dihardened tallow aliphatic acid salt, hardened tallow propylenediamine-dicoconut aliphatic acid salt, hardened tallow propylenediamine-disoybean aliphatic acid salt; coconut ethylenediamine-dilaurate, coconut ethylenediamine-dimyristate, tallow ethylenediamine-dipalmitate, coconut ethylenediamine-distearate, coconut ethylenediamine-dioleate, coconut ethylenediamine-ditallow aliphatic acid salt, cococnut ethylenediamine-dihardened tallow aliphatic acid salt, coconut ethylenediamine-dicoconut aliphatic acid salt, coconut ethylenediamine-disoybean aliphatic acid salt; coconut propylenediamine-dilaurate, coconut propylenediamine-dimyristate, coconut propylenediamine-dipalmitate, coconut propylenediamine-distearate, coconut propylenediamine-dioleate, coconut propylenediamine-ditallow aliphatic acid salt, coconut propylenediamine-dihardened tallow aliphatic acid salt, coconut propylenediamine-dicoconut aliphatic acid salt, coconut propylenediamine-disoybean aliphatic acid salt; soybean ethylenediamine-dilaurate, soybean ethylenediamine-dimyristate, soybean ethylenediamine-dipalmitate, soybean ethylenediamine-distearate, soybean ethylenediamine-dioleate, soybean ethylenediamine-ditallow aliphatic acid salt, soybean ethylenediamine-dihardened tallow aliphatic acid salt, soybean ethylenediamine-dicoconut aliphatic acid salt, soybean ethylenediamine-disoybean aliphatic acid salt; soybean propylenediamine-dilaurate, soybean propylenediamine-dimyristate, soybean propylenediamine-dipalmitate, soybean propylenediamine-distearate, soybean propylenediamine-dioleate, soybean propylenediamine-ditallow aliphatic acid salt, soybean propylenediamine-dihardened tallow aliphatic acid salt, soybean propylenediamine-dicoconut aliphatic acid salt, soybean propylenediamine-disoybean aliphatic acid salt and a mixture thereof.

The component [III] which is an essential additive to be added to a base lubricating oil according to this invention is an aliphatic monoamine (F) represented by the following general formula (5)

$$R^{12}—NH_2 \quad (5)$$

wherein $R^{12}$ is a straight-chain or branched-chain alkyl or straight-chain alkenyl group having 6 to 22 carbon atoms.

The $R^{12}$ is exemplified by an alkyl group such as hexyl groups (including all isomeric group), heptyl groups (including all isomeric group), octyl groups (including all isomeric group), nonyl groups (including all isomeric group), decyl groups (including all isomeric group), undecyl groups (including all isomeric group), dodecyl groups (including all isomeric group), tridecyl groups (including all isomeric group), tetradecyl groups (including all isomeric group), pentadecyl groups (including all isomeric group), hexadecyl groups (including all isomeric group), heptadecyl groups (including all isomeric group), octadecyl groups (including all isomeric group), nonadecyl groups (including all isomeric group), eicosyl groups (including all isomeric group), heneicosyl groups (including all isomeric group) and docosyl groups (including all isomeric group); and an alkenyl group such as octenyl groups (including all isomeric group), nonenyl groups (including all isomeric group), decenyl groups (including all isomeric group), undecenyl groups (including all isomeric group), docenyl groups (including all isomeric group), tridecenyl groups (including all isomeric group), tetradecenyl groups (including all isomeric group), pentadecenyl groups (including all isomeric group), hexadecenyl groups (including all isomeric group), peptadecenyl groups (including all isomeric group), octadecenyl groups (including all isomeric group), nonadecenyl groups (including all isomeric group), eicosenyl groups (including all isomeric group), heneicosenyl groups (including all isomeric group) and docosenyl groups (including all isomeric group); and an aliphatic group derived from fats and oils such as tallow, hardened tallow, coconut oil and soybean oil.

From the standpoint of its excellency particularly in friction-reducing effect, the aliphatic monoamine (F) of the component [III] used in this invention is preferably a compound of the formula (5) wherein $R^{12}$ is a member selected from a straight-chain alkyl and a straight-chain alkenyl group having 8 to 18 carbon atoms. Preferable compounds as the aliphatic monoamine include octyl amine (capryl amine), decyl amine, dodecyl amine (lauryl amine), tetradecyl amine (mirystyl amine), hexadecyl amine (palmityl amine), octadecyl amine (stearyl amine), 9-octadecenyl amine (oleyl amine), or an aliphatic monoamine derived from flats and oils such as tallow, hardened tallow, coconut oil or soybean oil, and a mixture thereof.

The specific combinations of the components [I], [II] and [III ] in the hydraulic working oil compositions for a buffer according to this invention may be for example (A)+(C)+(F); (A)+(D)+(F); (A)+(E)+(F); (B)+(C)+(F); (B)+(D)+(F); and (B)+(E)+(F); or a mixture of two or more combinations selected from the above combination examples.

It is essential that the hydraulic working oil compositions for a buffer of this invention contain the components [I], [II] and [III] as the essential components, and at the same time it is important in this invention that the contents of these components [I], [II] and [III] are required to satisfy the following formulae (6), (7) and (8). Only when the contents of these components [ I], [II] and [III] meet the requirements or the following formulae (6), (7) and (8), it is possible to obtain hydraulic working oil compositions for a buffer which exhibit very excellent durability (little degradation with the time of use) of friction-reducing effect and wear-preventing effect, and excellent storage stability:

$$W_I=0.1-5.0 \quad (6)$$

$$W_I/(W_{II}+W_{III})=1.5-20.0 \quad (7)$$

$$W_{II}/W_{III}=0.2-2.0 \quad (8)$$

wherein $W_I$, $W_{II}$ and $W_{III}$ represent the contents of components [I], [II] and [III], respectively (these contents being each expressed in weight % based on the total weight of the composition).

As shown in the above formula (6), the lower limit of the content (weight %) of component [I] based on the total weight of the composition of this invention is 0.1, preferably 0.5. If the value of $W_I$ is less than 0.1, the durability of friction-reducing effect and wear-preventing effect will be unfavorably lowered. On the other hand, the upper limit of $W_I$ is 5.0, preferably 3.0. If the value of $W_I$ exceeds 5.0, the durability of wear-preventing effect will be unfavorably lowered.

Further, as shown in the above formula (7), the lower limit of the value of $W_I/(W_{II}+W_{III})$ (i.e. the lower limit of the value of $W_I$, if the value of $(W_{II}+W_{III})$ is assumed to be 1 in the formula of $W_I(W_{II}+W_{III})$) is 1.5, preferably 2.0. When the component [I] is not contained (i.e., $W_I=0$) or when the value $W_I/(W_{II}+W_{III})$) is less than 1.5, the durability of friction-reducing effect will be poor and the storage stability will be unfavorably deteriorated. On the other hand, the upper limit of $W_I/(W_{II}+W_{III})$ is 20.0, preferably 15.0. If the value of $W_I/(W_{II}+W_{III})$ exceeds 20.0, the durability of friction-reducing effect and wear-preventing effect will be unfavorably lowered.

Further, as shown in the above formula (8), the lower limit of the value of $W_{II}+W_{III}$ (i.e. the lower limit of the value of $W_{II}$, if the value of $W_{III}$ is assumed to be 1 in the formula of $W_{II}/W_{III}$) is 0.2, preferably 0.3. When the component [II] is not contained (i.e., $W_{II}=0$) or when the value of $W_{II}/W_{III}$ is less than 0.2, the durability of friction-reducing effect will be unfavorably lowered. On the other hand, the upper limit of $W_{II}/W_{III}$ is 0.2, preferably 1.5. When the component [III] is not contained (i.e., $W_{III}=0$) or the value of $W_{II}/W_{III}$ exceeds 2.0, the storage stability will be unfavorably deteriorated.

As described above, although the hydraulic working oil composition of this invention having excellent performances can be obtained only by adding the components [I], [II] and [III] to the base lubricating oil, to further enhance the thus obtained hydraulic working oil composition in various performances, heretofore known additives for lubricating oils may be used singly or jointly in the above oil composition.

These additives include friction-reducing agents other than the components of the oil composition of this invention, such as an aliphatic alcohol, aliphatic acid, aliphatic amine and aliphatic amide; antioxidants such as phenol-, amine-, sulphur-, zinc dithiophosphate- and phenothiazine-based compounds; extreme-pressure agents such as sulfurized fats and oils, sulfides and zinc dithiophosphate; rust preventives such as petroleum sulfonates and dinonylnaphthalene sulfonate; metal deactivators such as benzotriazole and thiadiazole; metallic detergents such as alkaline earth metal sulfonates, alkaline earth metal phenates, alkaline earth metal salicylates and alkaline earth metal phosphonates; ashless dispersants such as succinic imide, succinic esters and benzyl amine; antifoaming agents such as methylsilicone and fluorosilicone; viscosity index improvers such as polymethacrylate, polyisobutylene and polystyrene; and pour point depressants.

Although the amount of these additives added may be arbitrary, the contents of the antifoaming agent, the viscosity index improver, the metal inactivator and each of the other additives in the oil composition are ordinarily 0.0005–1% by weight, 1–30% by weight, 0.005–1% by weight and 0.1–15% by weight in this order, based on the total amount of the oil composition, respectively.

DESCRIPTION OF THE PREFERRED EMBODIMENTS

This invention will be better understood by the non-limitative Examples and Comparative Examples.

EXAMPLES 1 TO 8, AND COMPARATIVE EXAMPLES 1 TO 8

In each of the Examples, the ingredients shown in Table 1 were mixed together and the resulting mixture was heated to 50° C. under stirring for two hours thereby to prepare a hydraulic working oil composition of this invention (Examples 1–8). The oil compositions of this invention so prepared were subjected to a duration test using an actual device to evaluate them for their friction-reducing effect and wear-preventing effect. The thus obtained results are shown in Table 1.

Additionally, the storage stability of these oil compositions was evaluated according to a storage stability test as shown below. The results of the evaluation are also shown in Table 1.

For the purpose of comparison, a composition without containing the Component [III] according to this invention (Comparative Example 1), a composition without containing the component [II] according to this invention (Comparative Example 2) and compositions containing all of the components [I] , [II] and [III] according to this invention in the ratios falling outside the ranges as defined by the present invention (Comparative Examples 3 to 8), were prepared and evaluated under the same conditions as in the Examples of this invention. The results of the evaluation are also shown in Table 2.

Duration Test Using Actual Device

Using two commercially available strut-type shock absorbers, duration tests were made under the following conditions until the end of two million frequency of oscillation application.

Temperature of a test oil: 80° C.

Amount of a test oil used: 330 ml/one shock absorber

Lateral load: 200 kgf

Entire amplitude of oscillation applied: 50 mm

Velocity of oscillation applied: 0.5 m/s

Friction-reducing effects

The shock absorbers were measured for their frictional coefficients at their frictional surfaces at the time of oscillation application frequency of zero (at the initial stage of the duration test) and at the time of oscillation application frequency of two millions (at the time of completion of the duration test), respectively. The frictional coefficients so measured are as shown in Table 1.

Wear-preventing effects

After the completion of the duration test, the shock absorbers were disassembled to visually evaluate the surface state of their friction surfaces (cylinders, pistons, rods and oil seals of the shock absorbers) with the results being as shown in Table 1. The degrees of the wear-preventing effects are represented in terms of six numerals 0–5 (numeral 5 being the best).

| | Appearance of Friction Surface | |
|---|---|---|
| Rating | Cylinder | Piston Rod |
| 5 | Nearly brand-new | Nearly brand-new (lustrous) |
| 4 | Slightly discolored | Slightly discolored |
| 3 | Greatly discolored | Greatly discolored |
| 2 | Longitudinally flawed | Longitudinally flawed |
| 1 | Abnormally worn | Abnormally worn |

Storage stability test

Each sample oil weighing 45 g was taken in a 50 ml glass beaker, after which the beaker was lidded with an aluminum foil. In one ease, a part of the lidded beakers with the sample oil therein were then kept in a thermostat at 140° C. for 96 hours (1), and, in another ease, the rest of the lidded beakers were then stored at 23° C. (room temperature) for 90 days (2). Then, the condition of each sample oil was visually evaluated. The results are shown in Table 1. The criteria for evaluating each sample oil for its storage stability are expressed in three grades 1, 2 and 3 (numeral 3 being the best).

| Rating | Appearance of Sample Oil |
|---|---|
| 3 | Transparent (no cloudiness, no sediment) |
| 2 | Occurrence of cloudiness within oil and on the surface thereof |
| 1 | Occurrence of sediment within oil and on the bottom of beaker |

In these Examples and Comparative Examples, the following components are used.

Lubricating oil as base oil

A: paraffin-based highly solvent-refined mineral oil (kinematic viscosity 10.2 $mm^2/s$ at 40° C.).

Component [I]

A: dioleyl acid phosphate

B: dioleyl hydrogen phosphite

Component [II]

A: ethyleneoxide adduct of oleylamine $R'-N-(C_2H_4-OH)_2$ (R': oleyl group)

B: oleyl ethylene diamine

C: tallow amine dioleate

Component [III]

A: oleyl amine

B: stearyl amine

As is apparent from the results of the performance evaluation tests shown in Table 1, the hydraulic working oil compositions (Examples 1–8) of the present invention are excellent in friction-reducing effects at the initial stage of the duration test and exhibit less degradation of their friction-reducing performances with the lapse of time. In addition to this, the oil compositions of the present invention exhibit less wear of the friction surfaces even at the end of the duration test and are excellent not only in wear-preventing effects but also in storage stability.

In contrast, the compositions of Comparative Examples 3 to 8, the composition containing none of the component [III] (Comparative Example 1), the composition containing none of the component [II] (Comparative Example 2), and compositions containing all of the components [I], [II] and [III] in the ratios falling outside the range as defined by the present invention (Comparative Examples 3 to 8), are inferior to those of the Examples of this invention in durability of the friction-reducing effect, wear-preventing effect and storage stability.

Thus, the foregoing demonstrates the excellency of the compositions of this invention over the comparative ones.

Effects of this Invention

As is apparent from the foregoing, the hydraulic working oil compositions of this invention are excellent in durability of friction-reducing effects at the initial stage of duration and exhibit less degradation of their friction-reducing performances with the lapse of Lime. In addition to this, the hydraulic working oil compositions of this invention are excellent not only in wear-preventing effects and storage stability but also in applicability to Teflon resin-impregnated bush members.

TABLE 1

| | | | | Ex. 1 | Ex. 2 | Ex. 3 | Ex. 4 |
|---|---|---|---|---|---|---|---|
| composition (wt. %) | base oil | | | A [94.7] | A [94.7] | A [94.7] | A [94.7] |
| | component [I] | | | A [1.0] | B [1.0] | A [1.0] | A [1.0] |
| | component [II] | | | A [0.1] | A [0.1] | B [0.1] | C [0.1] |
| | component [III] | | | A [0.1] | A [0.1] | A [0.1] | A [0.1] |
| | $W_I$ | | | 1.0 | 1.0 | 1.0 | 1.0 |
| | $W_I/(W_{II} + W_{III})$ | | | 5.0 | 5.0 | 5.0 | 5.0 |
| | $W_{II}/W_{III}$ | | | 1.0 | 1.0 | 1.0 | 1.0 |
| | 2,6-di-t-butyl-p-cresol | | | [0.6] | [0.6] | [0.6] | [0.6] |
| | polymethacrylate | | | [3.5] | [3.5] | [3.5] | [3.5] |
| performance | real machine | friction- | 1 friction coefficient | 0.101 | 0.102 | 0.101 | 0.102 |

TABLE 1-continued

| | | | | | | | |
|---|---|---|---|---|---|---|---|
| evaluation | performance | reducing | (at initial stage) | | | | |
| | | effect | 2 friction coefficient (at 2 million times) | 0.133 | 0.133 | 0.133 | 0.132 |
| | | | 2/1 | 1.32 | 1.30 | 1.32 | 1.29 |
| | | wear-preventing | surface states of friction site*1 | | | | |
| | | effect | cylinder | 5 | 5 | 5 | 5 |
| | | | piston rod | 5 | 5 | 5 | 5 |
| | storage stability | | 140° C. × 96 hours | 3 | 3 | 3 | 3 |
| | | | 23° C. × 90 days | 3 | 3 | 3 | 3 |
| | | | | Ex. 5 | Ex. 6 | Ex. 7 | Ex. 8 |
| composition (wt. %) | base oil | | | A [94.7] | A [94.7] | A [94.7] | A [95.2] |
| | component [I] | | | A [1.0] | A [1.0] | A [1.0] | A [0.5] |
| | component [II] | | | A [0.1] | A [0.05] | A [0.12] | A [0.1] |
| | component [III] | | | B [0.1] | A [0.15] | A [0.08] | A [0.1] |
| | $W_I$ | | | 1.0 | 1.0 | 1.0 | 0.5 |
| | $W_I/(W_{II} + W_{III})$ | | | 5.0 | 5.0 | 5.0 | 2.5 |
| | $W_{II}/W_{III}$ | | | 1.0 | 0.3 | 1.5 | 1.0 |
| | 2,6-di-t-butyl-p-cresol | | | [0.6] | [0.6] | [0.6] | [0.6] |
| | polymethacrylate | | | [3.5] | [3.5] | [3.5] | [3.5] |
| performance evaluation | real machine performance | friction-reducing | 1 friction coefficient (at initial stage) | 0.102 | 0.102 | 0.102 | 0.101 |
| | | effect | 2 friction coefficient (at 2 million times) | 0.131 | 0.134 | 0.133 | 0.132 |
| | | | 2/1 | 1.29 | 1.31 | 1.30 | 1.31 |
| | | wear-preventing | surface states of friction site*1 | | | | |
| | | effect | cylinder | 5 | 5 | 5 | 5 |
| | | | piston rod | 5 | 5 | 5 | 5 |
| | storage stability | | 140° C. × 96 hours | 3 | 3 | 3 | 3 |
| | | | 23° C. × 90 days | 3 | 3 | 3 | 3 |

*1: mean value of two shock absorbers (Strut-type)

TABLE 2

| | | | | Comp. Ex. 1 | Comp. Ex. 2 | Comp. Ex. 3 | Comp. Ex. 4 |
|---|---|---|---|---|---|---|---|
| composition (wt. %) | base oil | | | A [94.7] | A [94.7] | A [94.86] | A [95.62] |
| | component [I] | | | A [1.0] | A [1.0] | A [1.0] | A [0.08] |
| | component [II] | | | A [0.2] | — | A [0.02] | A [0.1] |
| | component [III] | | | — | A [0.2] | A [0.02] | A [0.1] |
| | $W_I$ | | | 1.0 | 1.0 | 1.0 | 0.08 |
| | $W_I/(W_{II} + W_{III})$ | | | 5.0 | 5.0 | 25.0 | 0.4 |
| | $W_{II}/W_{III}$ | | | — | 0 | 1.0 | 1.0 |
| | 2,6-di-t-butyl-p-cresol | | | [0.6] | [0.6] | [0.6] | [0.6] |
| | polymethacrylate | | | [3.5] | [3.5] | [3.5] | [3.5] |
| performance evaluation | real machine performance | friction-reducing | 1 friction coefficient (at initial stage) | 0.104 | 0.103 | 0.103 | 0.102 |
| | | effect | 2 friction coefficient (at 2 million times) | 0.142 | 0.215 | 0.246 | 0.217 |
| | | | 2/1 | 1.37 | 2.09 | 2.39 | 2.13 |
| | | wear-preventing | surface states of friction site*1 | | | | |
| | | effect | cylinder | 5 | 5 | 3 | 2 |
| | | | piston rod | 5 | 5 | 3 | 3 |
| | storage stability | | 140° C. × 96 hours | 1 | 2 | 3 | 3 |
| | | | 23° C. × 90 days | 2 | 1 | 3 | 3 |
| | | | | Comp. Ex. 5 | Comp. Ex. 6 | Comp. Ex. 7 | Comp. Ex. 8 |
| composition (wt. %) | base oil | | | A [92.9] | A [94.7] | A [94.7] | A [90.2] |

TABLE 2-continued

| | | | | | | | |
|---|---|---|---|---|---|---|---|
| | component [I] | | | A [1.0] | A [1.0] | A [1.0] | A [5.5] |
| | component [II] | | | A [1.0] | A [0.03] | A [0.17] | A [0.1] |
| | component [III] | | | A [1.0] | A [0.17] | A [0.03] | A [0.1] |
| | $W_I$ | | | 1.0 | 1.0 | 1.0 | 5.5 |
| | $W_I/(W_{II}+W_{III})$ | | | 0.5 | 5.0 | 5.0 | 27.5 |
| | $W_{II}/W_{III}$ | | | 1.0 | 0.18 | 5.7 | 1.0 |
| | 2,6-di-t-butyl-p-cresol | | | [0.6] | [0.6] | [0.6] | [0.6] |
| | polymethacrylate | | | [3.5] | [3.5] | [3.5] | [3.5] |
| performance evaluation | real machine performance | friction-reducing effect | 1 friction coefficient (at initial stage) | 0.104 | 0.102 | 0.102 | 0.130 |
| | | | 2 friction coefficient (at 2 million times) | 0.152 | 0.208 | 0.140 | 0.206 |
| | | | 2/1 | 1.46 | 2.04 | 1.37 | 2.00 |
| | | wear-preventing effect | surface states of friction site*1 | | | | |
| | | | cylinder | 5 | 3 | 5 | 2 |
| | | | piston rod | 5 | 3 | 5 | 2 |
| | storage stability | | 140° C. × 96 hours | 1 | 3 | 1 | 3 |
| | | | 23° C. × 90 days | 2 | 3 | 2 | 3 |

*1: mean value of two shock absorbers (Strut-type)

What is claimed is:

1. A hydraulic working oil composition for buffers which comprises:

a lubricating oil as a base oil,

[I] at least one phosphorus-containing compound which is a member selected from the group consisting of the components (A) and (B):

(A) a phosphoric acid ester of formula (1)

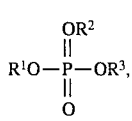

(1)

(B) a phosphorous acid ester of formula (2)

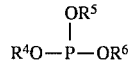

(2)

wherein $R^1$ and $R^2$ are each a straight-chain or branched-chain alkyl or alkenyl group having 8–18 carbon atoms, and $R^3$ is hydrogen, and $R^4$ and $R^5$ are each a straight-chain or branched-chain alkyl or alkenyl group having 8 to 18 carbon atoms, and $R^6$ is hydrogen,

[II]at least one nitrogen-containing compound which is a member selected from the group consisting of the following components (C), (D) and (E):

(C) an alkyleneoxide adduct of an aliphatic monoamine of formula (3)

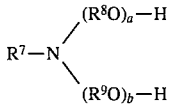

(3)

wherein $R^7$ is a straight-chain alkyl or alkenyl group having 8–18 carbon atoms, $R^8$ and $R^9$ are an ethylene or propylene group and a+b=1 to 5, (D) an aliphatic polyamine of formula (4)

$$R^{10}\text{-}(\text{NH}-R^{11})_c\text{-}NH_2 \quad (4)$$

wherein $R^{10}$ is a straight-chain alkyl or alkenyl group having 8–18 carbon atoms, $R^{11}$ is an ethylene or propylene group, and c is 1, and (E) a salt of said aliphatic polyamine (D) with an aliphatic acid having 8–18 carbon atoms, and

[III] (F) an aliphatic monoamine compound of formula (5)

$$R^{12}—NH_2 \quad (5)$$

wherein $R^{12}$ is a straight-chain alkyl or alkenyl group having 8–18 carbon atoms, said compounds [I], [II] and [III] being essential components added to said base oil and each component satisfying the following requirements represented by the following formulas (6) to (8):

$$W_I=0.1\text{–}5.0 \quad (6)$$

$$W_I/(W_{II}+W_{III})=1.5\text{–}20.0 \quad (7)$$

$$W_{II}/W_{III}=0.2\text{–}2.0 \quad (8)$$

wherein $W_I$, $W_{II}$ and $W_{III}$ represent the contents of components [I], [II] and [III] in the hydraulic working oil composition, respectively, and the contents being each expressed in % by weight based on the total weight of the composition.

2. The composition according to claim 1, wherein said $W_I$ of formula (6) is from 0.5 and 3.0.

3. The composition according to claim 1, wherein said $W_I/W_{II}+W_{III})$ of formula (7) is from 2 to 15.

4. The composition according to claim 1, wherein said $W_{II}/W_{III}$ of formula (8) is from 0.3 to 1.5.

5. The composition according to claim 1, which additionally contains at least one additive which is a member selected from the group consisting of a friction-reducing agent, an anti-oxidant, an extreme-pressure agent, a rust preventive, a metal deactivator, a metallic detergent, an ashless dispersant, an antifoaming agent, a viscosity index improver and a pour point depressant.

6. The composition according to claim 5, wherein the content of said antifoaming agent, the viscosity index improver, the metal inactivator and each of the other additives in the oil composition are 0.0005–1% by weight, 1–30% by weight, 0.005–1% by weight and 0.1–15% by weight in this order, based on the total amount of the oil composition.

7. The composition according to claim 5, wherein said friction-reducing agent is an aliphatic alcohol, an aliphatic acid, an aliphatic amine or an aliphatic amide.

8. The composition for buffers according to claim 5, wherein said anti-oxidant is a phenol-, an amine-, a sulphur-, a zinc dithiophosphate- or a phenothiazine- based compound.

9. The composition according to claim 5, wherein said extreme-pressure agent is a sulfurized fat or a sulfurized oil, a sulfide, or a zinc dithiophosphate.

10. The composition according to claim 5, wherein said rust preventive is a petroleum sulfonate or dinonylnaphthalene sulfonate.

11. The composition according to claim 5, wherein said metal deactivator is a benzotriazole or a thiadiazole.

12. The composition according to claim 5, wherein said metallic detergent is an alkaline earth metal sulfonate, an alkaline earth metal phenate, an alkaline earth metal salicylate or an alkaline earth metal phosphonate.

13. The composition according to claim 5, wherein said ashless dispersant is a succinic imide, a succinic ester or benzyl-amine.

14. The composition according to claim 5, wherein said antifoaming agent is a methylsilicone or a fluorosilicone.

15. The composition according to claim 5, wherein said viscosity index improver is a polymethacrylate, a polyisobutylene or polystyrene.

16. A process for forming a hydraulic working oil composition for buffers which comprises the steps of:

adding to a lubricating oil as a base oil,

[I] at least one phosphorus-containing compound which is a member selected from the group consisting of components (A) and (B):

(A) a phosphoric acid ester of formula (1)

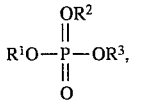

(1)

(B) a phosphorous acid esters of formula (2)

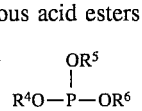

(2)

wherein $R^1$ and $R^2$ are each a straight-chain or branched-chain alkyl or alkenyl group having 8–18 carbon atoms, and $R^3$ is hydrogen, and $R^4$ and $R^5$ are each a straight-chain or branched-chain alkyl or alkenyl group having 8 to 18 carbon atoms, and $R^8$ is hydrogen, and

[II] at least one nitrogen-containing compound which is a member selected from the group consisting of the following components (C) to (E):

(C) an alkyleneoxide adduct of an aliphatic monoamine of formula (3)

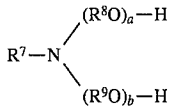

(3)

wherein $R^7$ is a straight-chain alkyl or alkenyl group having 8–18 carbon atoms, $R^8$ and $R^9$ are an ethylene or propylene group and a+b=1 to 5, (D) an aliphatic polyamine of formula (4)

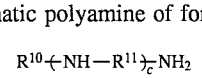

(4)

wherein $R^{10}$ is a straight-chain alkyl or alkenyl group having 8–18 carbon atoms, $R^{11}$ is an ethylene or propylene group, and c is 1, and (E) a salt of the said aliphatic polyamine (D) with an aliphatic acid having 8–18 carbon atoms, and

[III](F) an aliphatic monoamine of formula (5)

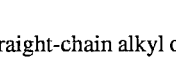

(5)

wherein $R^{12}$ is a straight-chain alkyl or alkenyl group having 8–18 carbon atoms, the compounds [I] to [III] being each required to satisfy the following formulas (6) to (8):

$$W_I=0.1\text{–}5.0 \quad (6)$$

$$W_I/(W_{II}+W_{III})=1.5\text{–}20.0 \quad (7)$$

$$W_{II}/W_{III}=0.2\text{–}2.0 \quad (8)$$

wherein $W_I$, $W_{II}$ and $W_{III}$ are the content of components [I], [II] and [III] in said hydraulic working oil composition, respectively, the content being expressed in % by weight based on the total weight of the composition, thereby a hydraulic working oil composition is obtained and then adding said hydraulic working oil composition to a buffer.

17. The process according to claim 16, wherein said $W_I$ in formula (6) is from 0.5 to 3.0.

18. The process according to claim 16, wherein said $W_I/W_{II}+W_{III})$ in formula (7) is from 2 to 15.

19. The process according to claim 16, wherein said $W_{II}/W_{III}$ in formula (8) is from 0.3 to 1.5.

* * * * *